US005272994A

United States Patent [19]

Scholl et al.

[11] Patent Number: 5,272,994

[45] Date of Patent: Dec. 28, 1993

[54] METHOD AND DEVICE FOR TRANSPORTING AND SEWING A WORKPIECE, POCKET BLANK AND POCKET FLAP

[75] Inventors: Hans Scholl, Oerlinghausen-Lipperreihe; Jochen Fischer, Detmold, both of Fed. Rep. of Germany

[73] Assignee: Durkopp Adler Aktiengesellschaft, Fed. Rep. of Germany

[21] Appl. No.: 914,756

[22] Filed: Jul. 15, 1992

[30] Foreign Application Priority Data

Jul. 20, 1991 [DE] Fed. Rep. of Germany ..... 4124164

[51] Int. Cl.[5] ..... D05B 21/00; D05B 39/00; A41H 33/00

[52] U.S. Cl. ..... 112/121.15; 112/114; 112/147; 223/38

[58] Field of Search ..... 112/121, 121.12, 121.15, 112/148, 306, 311, 320, 262.3, 104, 114, 121.14, 141, 147, 148; 2/247, 252; 223/37, 38

[56] References Cited

U.S. PATENT DOCUMENTS

| | | | |
|---|---|---|---|
| 4,281,606 | 8/1981 | Beisler | 112/121.15 |
| 4,690,078 | 9/1987 | Off et al. | 112/121.15 X |
| 4,736,695 | 4/1988 | Junemann | 112/121.12 |
| 4,768,451 | 9/1988 | Spencer, III | 112/121.15 X |
| 4,793,272 | 12/1988 | Scholl et al. | 112/121.15 |
| 4,809,627 | 3/1989 | Upmeier et al. | 112/121.12 |
| 4,819,572 | 4/1989 | Scholl et al. | 112/121.15 X |
| 4,850,292 | 7/1989 | Levy et al. | 112/121.15 X |
| 4,991,527 | 2/1991 | Scholl et al. | 112/121.15 X |
| 5,016,549 | 5/1991 | Sadlack et al. | 112/121.15 X |
| 5,123,367 | 6/1992 | Black et al. | 112/121.12 X |
| 5,133,271 | 7/1992 | Iwasaki et al. | 223/38 X |

FOREIGN PATENT DOCUMENTS 3830701 5/1989 Fed. Rep. of Germany .

OTHER PUBLICATIONS

Pfaff Special Service, Nr. 296-12-15815, 4 pp.

*Primary Examiner*—Clifford D. Crowder
*Assistant Examiner*—Ismael Izaguirre
*Attorney, Agent, or Firm*—Laff, Whitesel, Conte & Saret

[57] ABSTRACT

So as to sew a pocket-flap to a workpiece, the pocket-flap and a cut-out pocket are positioned relative to each other at a predetermined distance, in which they do not overlap, and relative to the workpiece. The workpiece, the cut-out pocket and the flap are conveyed to a sewing position without being displaced one in relation to the other. In the sewing position the cut-out pocket and the workpiece are joined together by means of a seam. The pocket-flap is then moved from a first position into a second position, in which it partially overlaps the cut-out pocket. It is then connected with the workpiece by a fastening seam.

15 Claims, 7 Drawing Sheets

METHOD AND DEVICE FOR TRANSPORTING AND SEWING A WORKPIECE, POCKET BLANK AND POCKET FLAP

BACKGROUND OF THE INVENTION

1. Field Of The Invention

The invention relates to a method of sewing a flap to a workpiece and to an automatic sewing device to put this method into practice.

2. Background Art

A device of a sewing machine is known from U.S. Pat. No. 4,281,606 for placing a flap or the like from an insertion station on to a workpiece in a holding position. In this case a flap clamp is provided on a workpiece clamp or a workpiece holder, respectively. Further, an inclined plate is provided, on which the flap can be oriented such that it projects with a marginal portion towards the workpiece holder and beyond the plate. Further, a clamping clasp is provided, by means of which the projecting marginal portion of the flap can be seized. The clamping clasp together with the flap is then drawn through between a clamping lever associated with the workpiece holder and the upper side of the workpiece holder, after which it is placed on to the workpiece. The method herein applied is extraordinarily time-consuming. Moreover, the constructional expenditure for the device is considerable. The positional accuracy of the flap on the workpiece is ensured only within certain limits.

From the PFAFF information brochure, "PFAFF 310-01 Special Service" (imprint no. 296-12-15815), it is known to sew a pocket on a workpiece by a corresponding seam as a first step. Then a flap is positioned and sewn on. This method, too, is time-consuming, the sewing on of the pocket and the positioning of the flap relative to the workpiece and the sewing on of the flap taking place in individual, separate operating cycles.

SUMMARY OF THE INVENTION

It is an object of the invention to specify a method of sewing a flap to a workpiece and an automatic sewing device to put this method into practice, in which the positioning and sewing on of the flap requires little expenditure of time and devices.

In accordance with the invention this object is solved in a method of the above generic kind by the following operational steps: The pocket-flap and a cut-out pocket are positioned relative to each other at a predetermined distance, in which they do not overlap, and relative to the workpiece, the pocket-flap taking a 1st position relative to the cut-out pocket and to the workpiece, the workpiece, the cut-out pocket and the pocket-flap are conveyed to a sewing position without being displaced one in relation to the other, the cut-out pocket and the workpiece are joined together in the sewing position by means of a seam, the pocket-flap is moved from the 1st position into a 2nd position, in which it partially overlaps the cut-out pocket, and the pocket-flap is connected with the workpiece by means of a fastening seam. In this case the flap is positioned relative to the pocket—though at a distance from it—in a virtually single operation, the cut-out pocket and the flap being in turn positioned relative to the workpiece. The sequence of the operations of positioning the individual parts relative to each other is substantially free. After the cut-out pocket has been sewn to the workpiece, which may be a trouser part or a shirt part, the flap only has to be displaced by a predetermined path and is then in its exact position relative to the cut-out pocket already sewn on and to the workpiece, so that—without the workpiece having to be removed from the sewing field of the sewing machine—the flap only has to be shifted and can then be sewn on. A reduction in the total processing time of the workpiece, the cut-out pocket and the flap passing through the sewing field of the sewing machine is thus attained, since operations are combined which so far had to be performed at separate workstations. This leads to a reduction of costs. At the same time this will result in an increase in quality, the risk of the flap not having an exact position relative to the cut-out pocket sewn on and to the workpiece being reduced.

An automatic sewing device for putting the method into practice comprises the following features: a sewing machine, a bearing plate for a workpiece, a workpiece holder with a pocket clamping plate and a pocket-flap clamping plate, a guide means for the conveyance of the workpiece holder from a take-over position into a sewing position adjacent to the sewing machine, a device to produce a relative movement between the workpiece holder and the sewing machine, and a device to retain the pocket-flap on the pocket-flap clamping plate. By comparison to the positioning known so far, of a cut-out pocket relative to a workpiece and to the subsequent sewing of these two parts one to the other, now only the flap has to be inserted additionally. The device is very flexible, since it can of course also be used for cut-out pockets to be sewn on conventionally. The fastening seam, by means of which the flap is applied to the workpiece, can be varied without any difficulty.

Further details of the invention will become apparent from the ensuing description of two exemplary embodiments taken in conjunction with the drawing.

DESCRIPTION OF THE PREFERRED EMBODIMENTS

Figure 1:
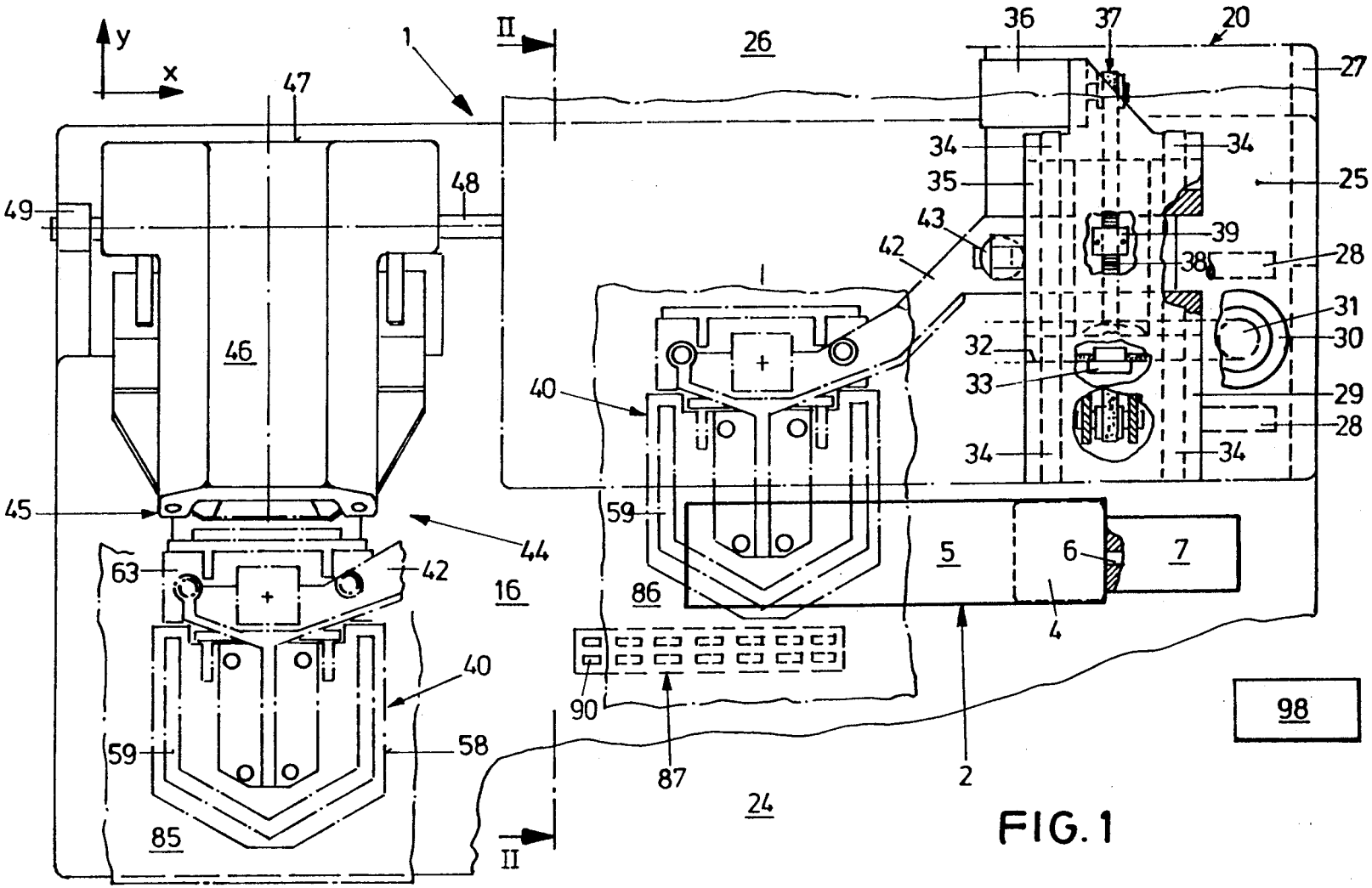
FIG. 1 is a plan view of an automatic sewing device according to the invention in an illustration partially broken open.
Figure 2:
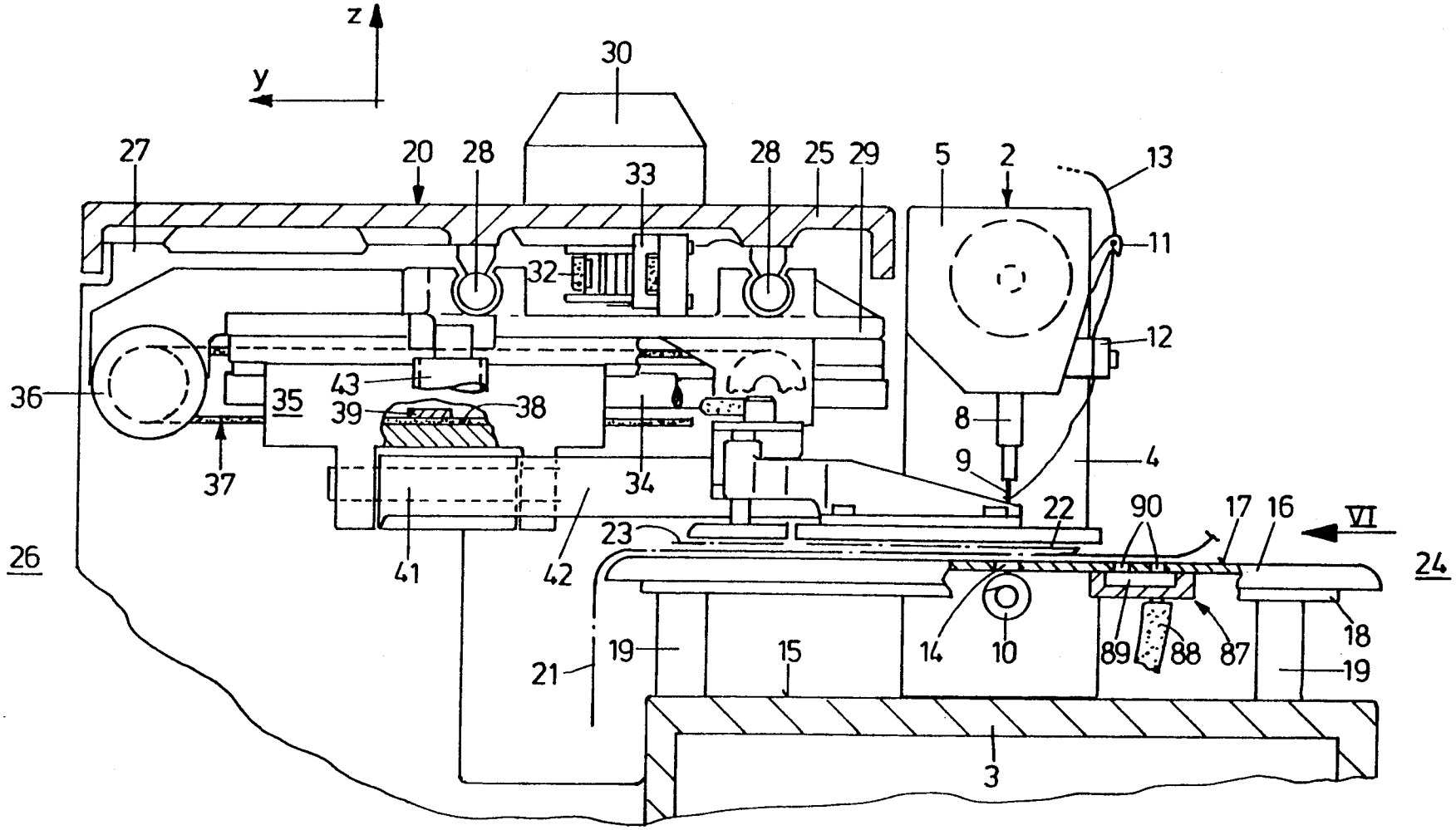
FIG. 2 is a vertical partial section through the automatic sewing device according to the section line II—II in FIG. 1.

The automatic sewing device illustrated in FIGS. 1 and 2 has a stand 1, on which a sewing machine 2 is stationarily arranged. It conventionally comprises a base plate 3, a standard 4 and an upper arm 5. An arm shaft 6 driven by an electric sewing drive motor 7 is conventionally supported in the arm 5 of the sewing machine 2. The drive of a needle bar 8 with a needle 9 and furthermore the drive of a looper 10 situated in the base plate 3 conventionally derive from the arm shaft 6. Via a thread lever 11 and a thread tightener 12 the needle 9 is supplied with a thread 13, which is conventionally seized by the looper 10, when the needle 9 plunges through the stitch hole 14 into the base plate, and which is connected with an under-thread not shown to form a two-thread lock-stitch seam.

A bearing plate 16, of which the upper side defines a sewing plane 17, is arranged on the stand 1 above the latter's upper side 15. This bearing plate 16 is—at least partially—supported on a supporting plate 18, which is retained by supports 19 on the stand 1. The bearing plate 16 also rests on the base plate 3 of the sewing machine 2 and, within the travelling path of the needle bar 8 with the needle 9 defined as the z-direction, has the stitch hole 14, which permits the needle 9 to pass towards the looper 10.

A guide means 20 for workpieces 21, 22, 23 to be sewn to each other is provided above the bearing plate 16. Seen from the operator's side 24 it is arranged after the sewing machine 2. It has an upper base plate 25, which is supported by way of vertical supporting walls 27 on the stand 1 in the latter's rear portion 26 opposite to the operator's side 24 and—seen from the operator's side—after the bearing plate 16. On the bottom side of this base plate 25 guide rods 28 are arranged, which extend parallel to each other in the x-direction and which have an x-carriage 29 displaceably supported on them. This x-carriage 29 is driven by an electric motor 30, which may be a gear motor, via a timing belt drive 31, of which the timing belt is connected with the x-carriage 29 by means of a fastening device 33.

Another pair of guide rods 34 extending parallel to each other in the y-direction, i.e. at right angles to the x-direction, are arranged on the bottom side of the x-carriage 29 and have a further carriage, a y-carriage 35, guided on them for displacement in the y-direction. Both carriages 29, 35 are suspendedly guided on the respective guide rods 28 and 34. The drive of the y-carriage 35 is effected via a timing belt drive 37 by an electric motor 36—if necessary also a gear motor—arranged in the rear portion 26 on the x-carriage 29. The timing belt 38 of this timing belt drive 37 is secured to the bottom side of the y-carriage 35 by means of a fastening device 39. The x-direction and the y-direction extend perpendicularly to each other and perpendicularly to the z-direction. The x-, y- and z-directions form a normal Cartesian coordinate system. The x- and the y-directions extend in parallel to the sewing plane 17. The x-direction is parallel to the main longitudinal direction of the sewing machine 2, i.e. parallel to the arm shaft 6.

On the bottom side of the y-carriage 35 a workpiece holder 40 is supported to be tiltable about a tilt axis 41 extending parallel to the y-direction. To this end the workpiece holder 40 is secured to the end of an angle lever 42, the other end of which is supported on the tilt axis 41. The angle lever 42 is twice bent at right angles, namely, on the one hand, away from the workpiece holder 40 in the y-direction towards the rear portion 26 and, on the other hand, from the bearing plate 16 upwards in the z-direction towards the bottom side of the y-carriage 35. Between the tilt axis 41 and the workpiece holder 40 a lift and press drive 43 is provided engaging, on the one hand, with the angle lever 42 and, on the other hand, with the y-carriage 35. It is a linear drive conventionally designed as a pneumatically actuatable piston-cylinder drive. As seen from the above, the total guide means 20 with all its accompanying components is arranged above the bearing plate 16, i.e. it can be arranged very close to the sewing machine 2.

The sewing machine 2 and the guide means 20 are preceded by a preparatory station 44, where the 1st workpiece 21, for instance a shirt forepart, and the 2nd workpiece, which is a cut-out pocket, are placed in a position relative to each other necessary for sewing. The cut-out pocket is folded by means of a folding device 45 in the preparatory station 44. The folding device 45 has a cover-like carrier 46, which is arranged above the bearing plate 16 and projects over the latter towards the rear portion 26 of the stand 1. At its rear end the carrier 46 has a lever arm 47 extending downwards. In the vicinity of its transition into this lever arm 47 the carrier 46 is supported tiltably about a tilt axis 48, which extends in parallel to the x-direction and is supported in the bearing arm 49 stationary within the stand. The only partially shown folding tools necessary to fold the 2nd workpiece 22 (cut-out pocket), by means of which the cut-out pocket is bent over and positioned accurately on the lower 1st workpiece 21, are accommodated in the carrier 46 projecting freely over the bearing plate 16. Such folding devices are generally known and spread in practice, so that a detailed description is not necessary. As an example reference is made to U.S. Pat. No. 4,813,362, U.S. Pat. No. 4,793,272 and U.S. Pat. No. 4,785,749.

A folding sword 50 of thin sheet is provided in the space between the carrier 46 and the bearing plate 16 on the preparatory station 44; it is supported to be displaceable in the y-direction by means of sliding bearings 51 and can simultaneously be tilted approximately in the z-direction relative to the bearing plate 16. The folding sword 50 has a contour conventionally corresponding to the shape of the 2nd workpiece 22 to be folded. In the present case it corresponds in shape to the pocket to be sewn on the 1st workpiece 21. The folding sword 50 is very thin, for instance made of spring steel. It has a stop bar 52 and resilient clamps 53, under which is placed the 2nd workpiece 22, i.e. the cut-out pocket, so that is held positioned on the folding sword 50. As far as described, the automatic sewing device is in detail known from U.S. Pat. No. 4,809,627, which may be referred to for any details not specified herein.

By means of countersunk screws 54 the folding sword is secured to a bearing plate 55, which itself is in turn arranged on the sliding bearings 51. This bearing plate 55 serves as a bearing plate for the 3rd workpiece 23, which is a flap, i.e. a pocket flap to be applied over the upper part of the pocket. This bearing plate 55 is provided with a stop bar 56, against which the 3rd workpiece 23 is placed to abut. Here, too, resilient clamps 57 are arranged, by means of which the 3rd workpiece (flap) is held positioned on the bearing plate 55.

Figure 4:
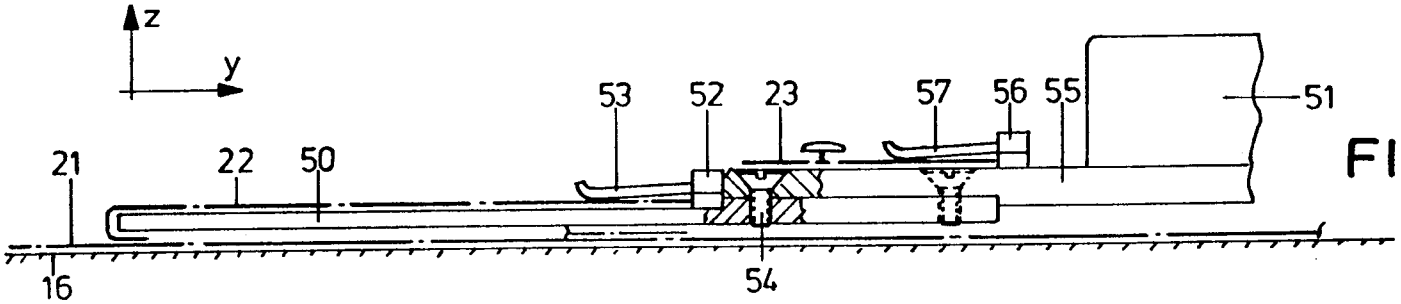
FIG. 4 is a lateral view of the folding sword according to the directional arrow IV in FIG. 3.

As seen in FIG. 4, the bearing plate 55, namely its upper side serving as a support for the 3rd workpiece 23, is situated above the stop bar 52 and above the clamps 53, which are associated with the folding sword 50.

Figure 5:
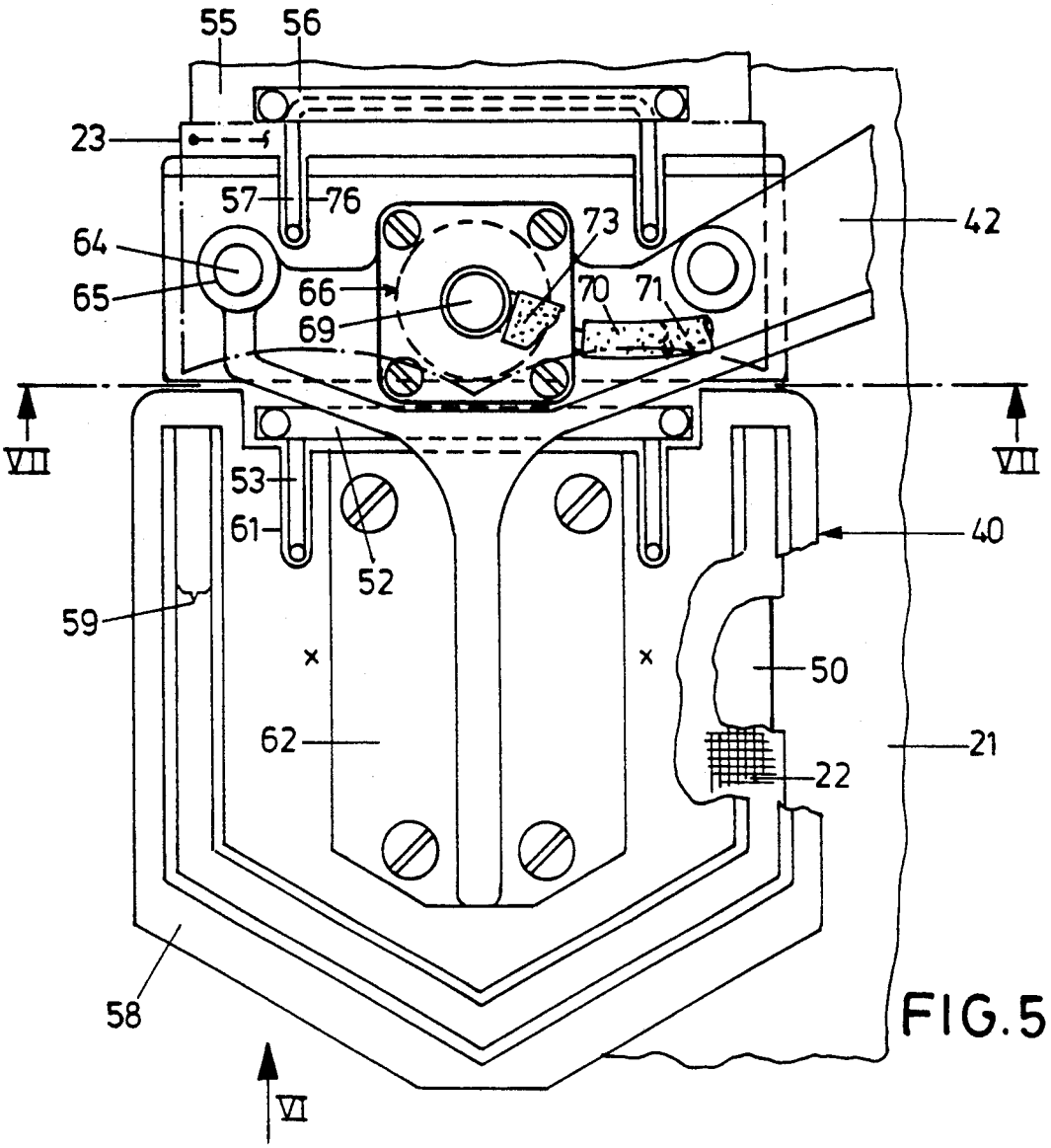
FIG. 5 is a plan view of a workpiece holder with the folding sword located underneath.

The workpiece holder 40 has a pocket clamping plate 58 having a for instance U-shaped slit 59, of which the course corresponds to the path of a seam 60 to be produced and by means of which the 2nd workpiece 22 (cut-out pocket) is to be applied on the 1st workpiece (shirt forepart). This pocket clamping plate 58 further has a recess 61 suited to match the clamps 53 and the stop bar 52, so that these latter—as seen in FIG. 5—can project into the recess 61 when the clamping plate 58 and the folding sword 50 coincide. The pocket clamping plate 58 is secured to the angle lever 42 by means of a retaining plate 62.

Figure 7:
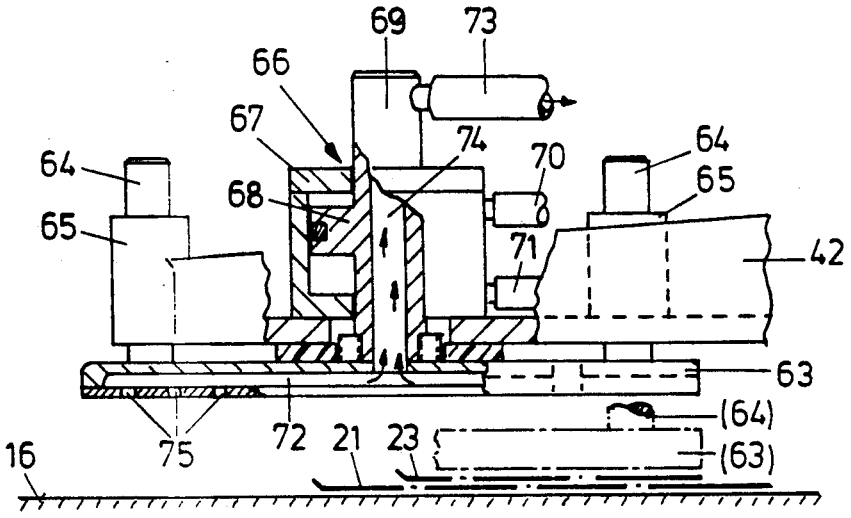
FIG. 7 is a cross-section through the workpiece holder according to the section line VII—VII in FIG. 5.

Furtheron, a pocket-flap clamping plate 63 is provided. It has guiding bolts 64, which are displaceably guided in corresponding bearings 65 on the angle lever 42, and that perpendicular to the bearing plate 16, i.e. in the z-direction. A drive 66 for the pocket-flap clamping plate 63 is further formed on the angle lever 42 as a linear drive. It consists of a cylinder 67 actuatable by compressed air and secured to the angle lever 42. Inside of it a piston 68 is displaceably arranged, of which the piston rod 69 is guided to exit at both ends of the cylinder 67 and is connected at its one lower end with the pocket-flap clamping plate 63. On both sides of the piston 68 compressed air connections 70, 71 open into the cylinder 67, so that dependent on the compressed air actuation the pocket-flap clamping plate can be moved into an upper position—shown on the left in FIG. 7—or—as shown on the right in FIG. 7—into a lower position, in which it is directly above the bearing plate 16.

The pocket-flap clamping plate 63 is formed as a suction plate, i.e. it has a suction chamber 72 extending over its entire surface and connected to a partial vacuum connection 73, the piston rod 69 serving as a partial vacuum channel 74. On its bottom side facing towards the bearing plate 16 the pocket-flap clamping plate 63 is provided with a plurality of openings 75 opening into the suction chamber 72. As seen in FIG. 5, the pocket-flap clamping plate 63 also has a recess 76 for the stop bar 56 with the clamps 57.

Figure 8:
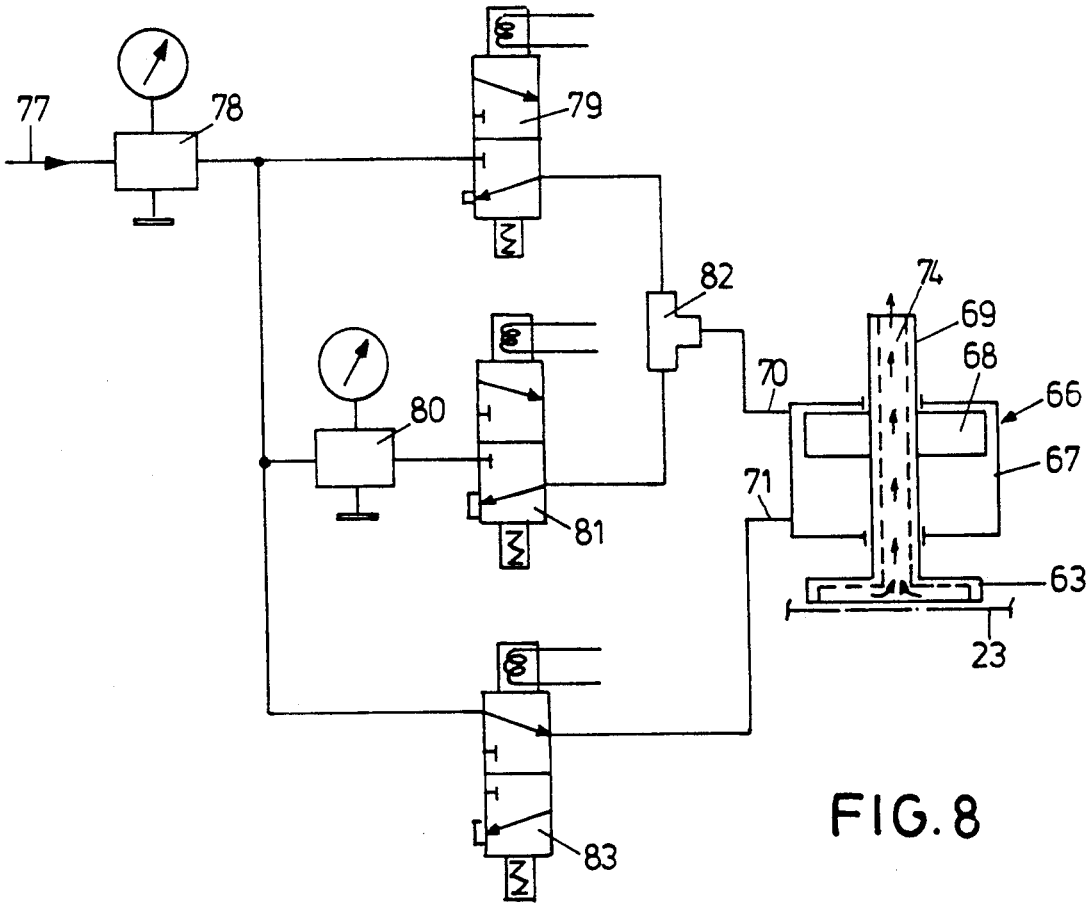
FIG. 8 is a pneumatic circuit diagram for a drive of a pocket-flap clamping plate.

The pocket-flap clamping plate 63 can be pressed downwards at a differing pressure, i.e. by different forces. Via its compressed-air connection 70 the cylinder 6 can therefore be acted upon by a lower initial pressure or a higher main pressure. It can be seen in FIG. 8 that compressed air is supplied from a compressed-air source not shown via a compressed-air supply line 77 to a 1st pressure regulator 78 for the (higher) main pressure. From the 1st pressure regulator 78 the compressed air is on the one hand supplied to a 1st valve 79 for the main pressure, which is connected before the compressed-air connection 70. From the 1st pressure regulator 78 the compressed air is further supplied to a 2nd pressure regulator 80 for a (lower) initial pressure, from where, at a correspondingly lower pressure, it is supplied to a 2nd valve 81, via which the initial pressure can also be supplied to the compressed air connection 70. A double check valve 82 is provided between the first valve 79 and the 2nd valve 81 and the compressed-air connection 70.

Finally, a 3rd valve 83 is provided, which is arranged downstream of the 1st pressure regulator 78 and which is provided with the compressed-air connection 71, via which an elevation of the pocket-flap clamping plate 63 takes place. The valves 79, 81, 83 are structured as electromagnetic valves. The pressure regulators 78 and 80 are adjustable.

The performance is as follows:

A 1st workpiece 21, i.e. the shirt forepart, is placed under the folding device 45 on the bearing plate 16, the folding sword 50 being in a position above the 1st workpiece 21 and moved out of the cover-like carrier 46. Then the 2nd workpiece 22, i.e. the cut-out pocket, is placed on the folding sword 50 and moved against the stop bar 52, where it is positioned and simultaneously held in place by the clamps 53. In like manner the 3rd workpiece 23, i.e. the pocket-flap, is placed on to the bearing plate 55 and moved against the stop bar 56, whereby it is simultaneously held in place by the clamps 57. Then the 2nd workpiece 22, namely the cut-out pocket, is bowed by bow means not shown, i.e. its rim is bent over to contact the bottom side of the folding sword 50. Then the folding sword 50 together with the bow means not shown is lowered on to the 1st workpiece 21 located on the bearing plate. The bow means are released from the folding sword and as a whole tilted upwards and moved away backwards into the carrier 46. With the exception of the 3rd workpiece 23 being placed on the bearing plate 55, this sequence of operations is known from the afore-mentioned U.S. Pat. Nos. 4,813,362, 4,785,749 and 4,793,272, which are referred to in this regard.

Figure 6:
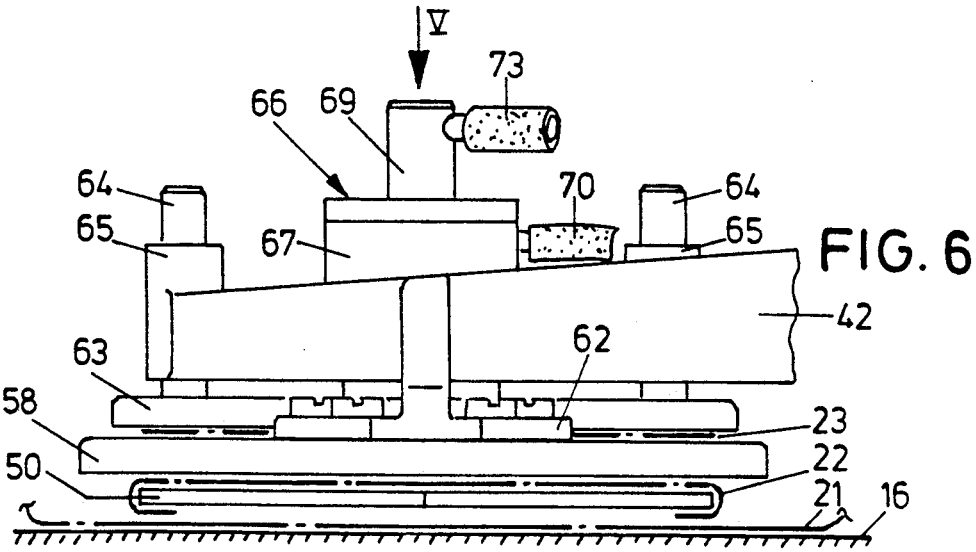
FIG. 6 is a front view of the workpiece holder with the folding sword located underneath according to the directional arrow VI in FIG. 5.

By correspondingly triggering the motors 30, 36 the workpiece holder 40 is moved into a position above the described take-over position 85—shown on the left in FIG. 1. Through corresponding actuation of the lift and press drive 43 the workpiece holder 40 is lowered in the direction towards the bearing plate 16 on to the folding sword 50 and the bearing plate 55, namely into the position seen in FIG. 6, until the pocket clamping plate 58 has taken its desired position in relation to the folded 2nd workpiece 22 and the flap clamping plate 63 has taken its desired position above the 3rd workpiece 23. In this case the pocket-flap clamping plate 63 has taken its upper position, in which the piston 68 is actuated by compressed air via the 3rd valve 83. Once the workpiece holder 40 is placed on, the piston 68 is actuated by way of the compressed-air connection 70 and the 2nd valve 81 by an initial pressure of for instance 3 bar, so that the flap clamping plate 63 is pressed slightly against the 3rd workpiece 23. Simultaneously the suction chamber 72 is subjected to a partial vacuum via the partial vacuum connection 73, so that the 3rd workpiece 23 is sucked against the flap clamping plate 63, where it is held in place. The folded 2nd workpiece 22 is pressed by the pocket clamping plate 58 against the 1st workpiece 21 and both are together pressed on the bearing plate 16. Then the folding sword 50 together with the bearing plate 55 is drawn in the y-direction from under the workpiece holder 40, the 2nd workpiece 22 and the 3rd workpiece 23 remaining in their described position. By a corresponding reversal of the drive 66 by way of the 3rd valve 63 the flap clamping plate 63 is moved together with the 3rd workpiece (flap) into the lifted position.

By a corresponding drive of the motors 30, 36 the three workpieces 21, 22, 23 are then moved from the take-over position 85 into the sewing position 86 shown in FIG. 1, the pocket clamping plate 58 of the workpiece holder 40 pressing the 2nd workpiece 22 and the 1st workpiece 21 non-displaceably one relative to the other on to the bearing plate 16 and displacing it on the latter. Then the seam 60 is sewn in usual manner, by means of which the 2nd workpiece 22 and the 1st workpiece 21 are joined together.

At least during the sewing operation, but usually also when the workpieces 21, 22, 23 are passed from the take-over position 85 to the sewing position 86, the flap clamping plate 63 is pressed against the 1st workpiece 21 so as to avoid any displacements of the 1st workpiece 21 relative to the 3rd workpiece 23 during the passing and sewing operation.

Figure 10:
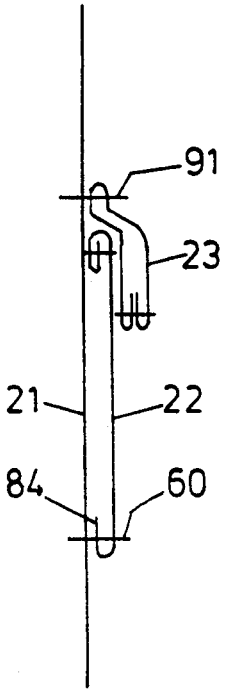
Figure 9:
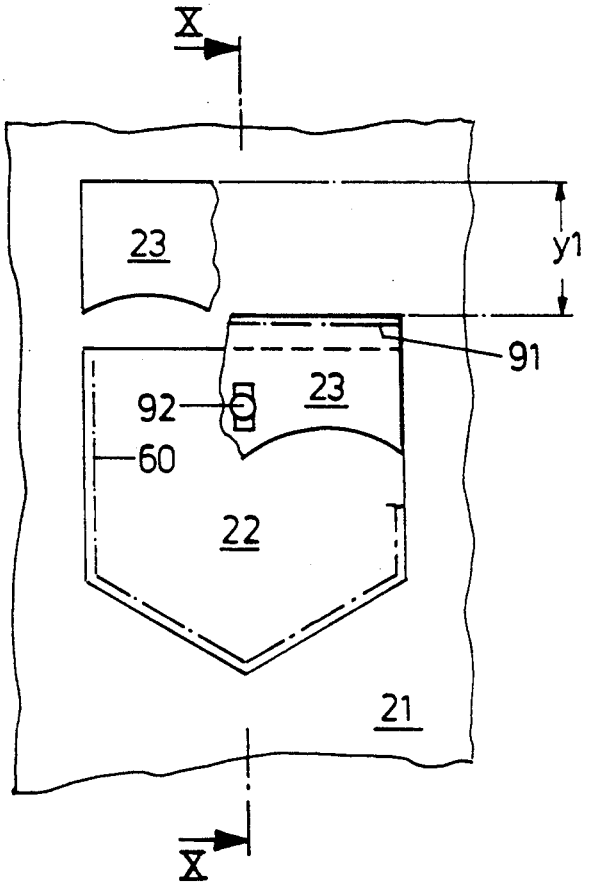
FIG. 9 is an illustration of the sequence of operations of positioning a flap on a shirt forepart with a pocket sewn on, FIG. 10 is a section through FIG. 9 according to the section line X—X in FIG. 9.

After the sewing operation the 1st workpiece 21 is fixed by means of a retaining device 87 on the bearing plate 16. The retaining device 87 has a suction chamber 89 connected to a partial vacuum connection and connected with the surface of the bearing plate 16 by means of suction openings 90 provided in the latter. By corresponding partial vacuum actuation of this suction chamber 89 the 1st workpiece 21 and thus also 2nd workpiece 22 already sewn to it are held in a fixed position. Then the workpiece holder 40 is lifted by corresponding actuation of the lift and press drive 43, whereby the 3rd workpiece 23 is lifted off the 1st workpiece 21. Then the workpiece holder 40 is displaced by the motor 36 of the y-carriage 35 being correspondingly driven by a predetermined dimension y1 in the negative y-direction, whereby the 3rd workpiece 23 (flap) takes the desired position above the 1st workpiece 21 and the 2nd workpiece 22, as in particular seen in FIG. 9. Then the workpiece holder is again lowered on to the workpieces 21, 22 and the drive 66 is acted upon by the main pressure via the 1st valve 79, so that the flap clamping plate 63 with the flap (3rd workpiece 23) is firmly pressed on to the two workpieces 21, 22, and that in the position shown on the right in FIG. 10 and FIG. 9. Then the 3rd workpiece 23 is fastened to the 1st workpiece 21 by a flap fastening seam 91.

Figure 3:
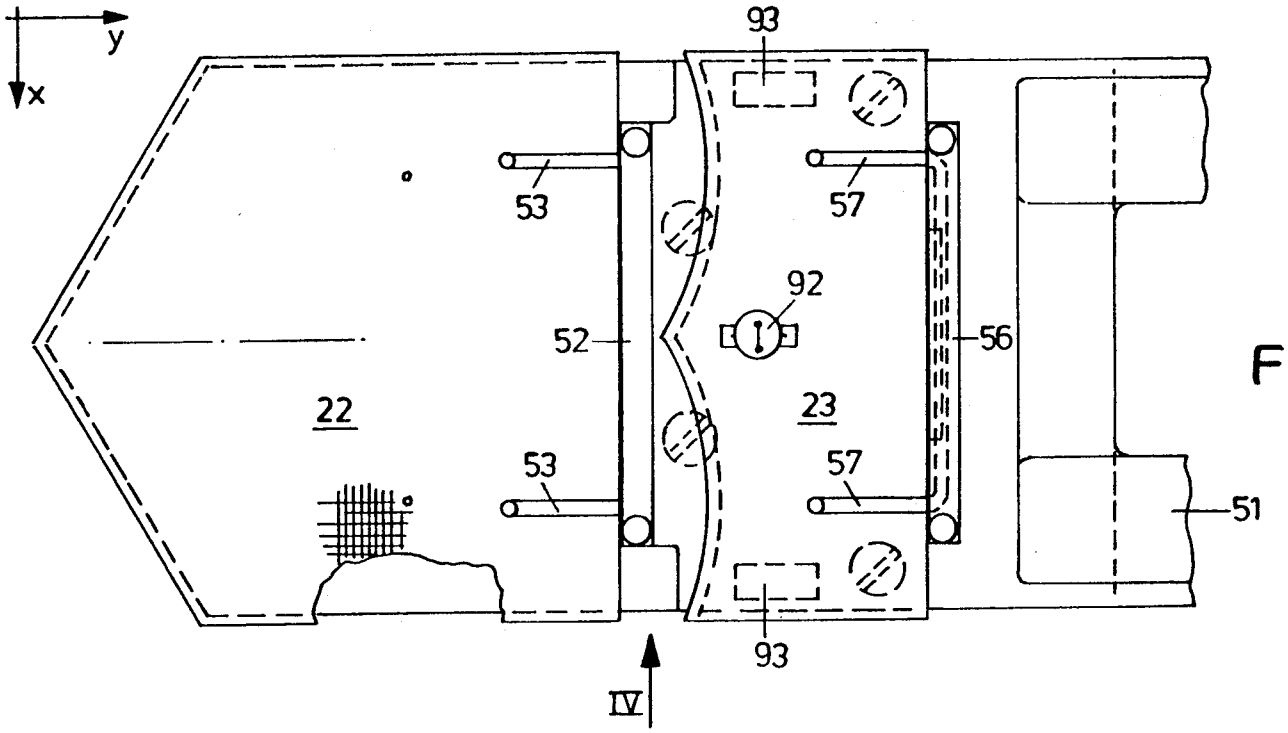
FIG. 3 is a plan view of a folding sword.

The flap (3rd workpiece 23) may be provided with an ornamental button even prior to the mounting. To close the flap, "Velcro" strips 93 are arranged on the latter—as outlined in FIG. 3. In such a case a recess for the ornamental button 92 must of course be available in the flap clamping plate 63.

During the automatically proceeding sewing operation the operator can place new workpieces into the preparatory station in the way already described. They are sewn after the finished workpieces 21 to 23 have been unstacked and the workpiece holder 40 has returned to the take-over position 85.

Figure 11:
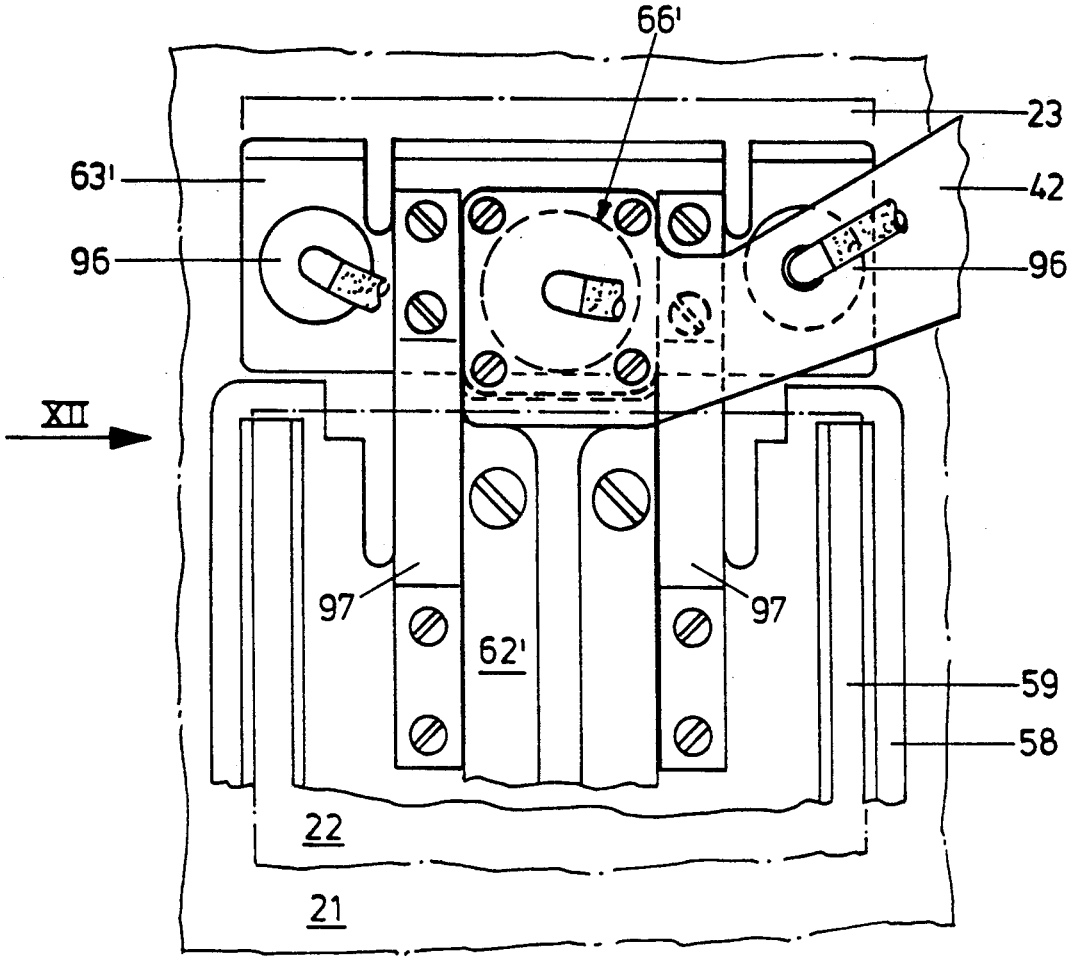
FIG. 11 is a partial plan view of a modified embodiment of a workpiece holder.
Figure 12:
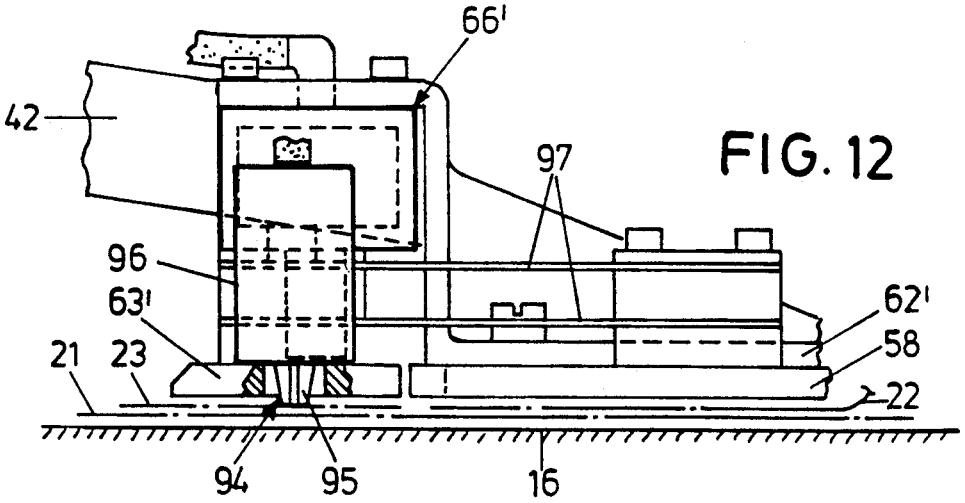
FIG. 12 is a partial lateral view of the modified workpiece holder according to the directional arrow XII in FIG. 11.

The embodiment according to FIGS. 11 and 12 only differs from the aforedescribed in that a gripping and retaining device is installed instead of a vacuum retaining device. This gripping and retaining device 94 has grip tongs 95 passing through the pocket-flap clamping plate 63' and which can be operated by means of a pneumatically actuatable drive 96. These grip tongs 95 grip the 3rd workpiece in its surface facing towards the pocket-flap clamping plate 63' without, however, distorting it. Such gripping and retaining devices 94 are commercially available and known for instance from DE 38 30 701 A1. With this embodiment further simplification resides in that the flap clamping plate 63' is secured to the retaining plate 62' by means of a pair of leaf springs 97, the upper leaf spring being prestressed such that the pocket-flap clamping plate is lifted upwards when the drive 66' is relieved. The drive 66' may therefore be a single-acting drive; the 3rd valve 83 and the associated compressed-air connection 71 may be omitted.

The triggering of all the drives is made through a programmable control 98.

In a simplified embodiment it is also possible to work without a preparatory station 44. For instance, in a simplified method and with a simplified automatic sewing device, the 2nd workpiece 22 (cut-out pocket) and the 3rd workpiece 23 (pocket-flap) could be positioned manually on the 1st workpiece 21 (shirt forepart) to be then directly taken over by the workpiece holder 40. It is further possible to provide a preparatory station 44, but no folding device 45, i.e. in this case only some accommodation for the 2nd workpiece 22 (cut-out pocket) must be provided, which would not have to be formed as a folding sword or as a closed plate. In this case it need not necessarily be structured such that it can be drawn out from under the workpiece holder 40.

What is claimed is:

1. A method for sewing a pocket-flap to a workpiece with the use of an automatic sewing device comprising the following operational steps:

the pocket-flap (23) and a cut-out pocket (22) are positioned relative to each other at a predetermined distance, in which they do not overlap, and relative to the workpiece (21), the pocket-flap (23) being positioned in a first position relative to the cut-out pocket (22) and the workpiece (21);

the workpiece (21), the cut-out pocket (22) and the pocket-flap (23) are conveyed to a sewing position (86) without being displaced one in relation to the other;

in the sewing position (86) the cut-out pocket (22) and the workpiece (21) are joined together by means of a seam (60);

the pocket-flap (23) is moved from the first position into a second position, in which said pocket flap (23) partially overlaps the cut-out pocket (22); and the pocket-flap (23) is connected with the workpiece (21) by means of a fastening seam (91).

2. An automatic sewing device for sewing a pocket-flap to a workpiece by positioning the pocket-flap (23) and a cut-out pocket (22) relative to each other at a predetermined distance, in which they do not overlap, and relative to the workpiece (21), the pocket-flap (23) being positioned in a first position relative to the cut-out pocket (22) and to the workpiece (21);

conveying the workpiece (21), the cut-out pocket (22) and the pocket-flap (23) to a sewing position (86) without their being displaced one in relation to the other;

joining together the cut-out pocket (22) and the workpiece (21) in the sewing position (86) by means of a seam (60);

moving the pocket-flap (23) from the first position into a second position, in which it partially overlaps the cut-out pocket (22); and connecting the pocket-flap (23) with the workpiece (21) by means of a fastening seam (91);

comprising:

a sewing machine (2);

a bearing plate (16) for bearing a workpiece (21);

a workpiece holder (40) with a cut-out pocket clamping plate (58) and a pocket-flap clamping plate (63, 63'), which pocket-flap clamping plate (63, 63') is displaceable from said first position to said second position;

a guide means for the conveyance of the workpiece holder (40) from a take-over position (85) into a sewing position (86) adjacent to the sewing machine (2);

a driving device (30, 36) to produce a relative movement between the workpiece holder (40) and the sewing machine (2); and a device to retain the pocket-flap (23) on the pocket-flap clamping plate (63, 63').

3. An automatic sewing device according to claim 2, wherein said device to retain the pocket-flap (23) on the pocket-flap clamping plate (63) has a vacuum device.

4. An automatic sewing device according to claim 2, wherein the device to retain the pocket-flap (23) on the pocket-flap clamping plate (63') is provided with a gripping device (94).

5. An automatic sewing device according to claim 2, wherein the pocket-flap clamping plate (63, 63') is displaceable in relation to the workpiece holder (40) and substantially perpendicularly to the bearing plate (16).

6. An automatic sewing device according to claim 5, wherein the pocket-flap clamping plate (63, 63') is provided with a linear drive (66, 66').

7. An automatic sewing device according to claim 5, wherein the pocket-flap clamping plate (63, 63') is actuatable by a first force and a second force in the direction towards the bearing plate (16), the first and the second force having different amounts.

8. An automatic sewing device according to claim 2, wherein a retaining device (87) is provided for retaining the workpiece (21).

9. An automatic sewing device according to claim 8, wherein the retaining device (87) comprises a vacuum device arranged on the bearing plate (16).

10. An automatic sewing device according to claim 2, wherein a receiver for receiving a cut-out pocket (22) and a support (55) for supporting a pocket-flap (23) are provided.

11. An automatic sewing device according to claim 10, wherein said receiver comprises an accommodation plate (50) and the support a support plate (55).

12. An automatic sewing device according to claim 11, wherein the accommodation plate for a cut-out pocket (22) is formed as a folding sword (50) and the folding sword (50) and the support plate (55) for a pocket-flap (23) are part of a folding device (45).

13. An automatic sewing device according to claim 10, wherein said receiver for said cut-out pocket (22) and said support (55) for said pocket-flap (23) are formed as one piece.

14. An automatic sewing device according to claim 10, wherein the support (55) for a pocket-flap (23) is arranged above the accommodation (50) for the cut-out pocket (22).

15. An automatic sewing device according to claim 2, wherein the pocket-flap clamping plate (63') is connected to prestressed springs (97) pressing said pocket-flap clamping plate (63) in relation to the workpiece holder (40) away from the bearing plate (16).

* * * * *